US011939851B2

(12) United States Patent
Alharith

(10) Patent No.: US 11,939,851 B2
(45) Date of Patent: Mar. 26, 2024

(54) MICROWAVE HEATING TECHNIQUE FOR TREATMENT OF CONDENSATE BUILDUP

(71) Applicant: SAUDI ARABIAN OIL COMPANY, Dhahran (SA)

(72) Inventor: Abdullah M. Alharith, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/818,536

(22) Filed: Aug. 9, 2022

(65) Prior Publication Data

US 2024/0052736 A1 Feb. 15, 2024

(51) Int. Cl.
*E21B 43/24* (2006.01)
*E21B 36/04* (2006.01)

(52) U.S. Cl.
CPC ..... *E21B 43/2401* (2013.01); *E21B 36/04* (2013.01)

(58) Field of Classification Search
CPC ..... E21B 43/2401; E21B 36/04
See application file for complete search history.

(56) References Cited

U.S. PATENT DOCUMENTS 5,247,994 A * 9/1993 Nenniger ..... E21B 36/04 219/415
6,189,611 B1 2/2001 Kasevich
8,720,550 B2 5/2014 Banerjee et al.
10,053,959 B2 8/2018 Ayub et al.
11,187,066 B2 11/2021 Aljindan et al.
2012/0012319 A1* 1/2012 Dennis ..... E21B 43/2401 166/66.5
2014/0014327 A1* 1/2014 Badri ..... E21B 43/24 175/2
2014/0352973 A1 12/2014 Dwars
(Continued)

FOREIGN PATENT DOCUMENTS

CA 2777956 A1 12/2012
CN 103225497 B 7/2015

OTHER PUBLICATIONS

Allan, Shawn, et al., "Microwave Heating Technologies", Heat Treating Process, Nadcap, May/Jun. 2008, pp. 39-42 (4 pages).
(Continued)

*Primary Examiner* — D. Andrews
(74) *Attorney, Agent, or Firm* — Osha Bergman Watanabe & Burton LLP

(57) ABSTRACT

A downhole tool includes a body including a microwave generator, a susceptor shell connected to the body, and a thermometer connected to the body. The susceptor shell includes a wall made of a susceptor material and a cavity formed between the wall and the body. A system includes a well extending from a surface, a microwave heating tool positioned in the well, and an electrical cable extending from a power source at the surface to the microwave heating tool. A method of treating condensate buildup in a well includes lowering a microwave heating tool into the well to a treatment zone including accumulated condensates, providing power to the microwave heating tool via an electrical cable, increasing a temperature of the treatment zone to an elevated temperature using heat generated by the microwave heating tool, and removing the accumulated condensates in the treatment zone.

16 Claims, 3 Drawing Sheets

(56) References Cited

U.S. PATENT DOCUMENTS

2020/0290892 A1* 9/2020 Al-Mulhem ..... C09K 8/58

OTHER PUBLICATIONS

Amani, Mahmoud and Nguyen T. Nguyen, "An Overview of Methods to Mitigate Condensate Banking in Retrograde Gas Reservoirs", Advances in Petroleum Exploration and Development, CSCanada, vol. 9, No. 2, 2015, pp. 1-6 (6 pages).

Bjorndalen, N. and M.R. Islam, "The effect of microwave and ultrasonic irradiation of crude oil during production with a horizontal well", Journal of Petroleum Science and Engineering, ScienceDirect, Elsevier B.V., vol. 43, 2004, pp. 139-150 (12 pages).

Karami, Saeed, et al., "Condensate blockage removal using microwave and ultrasonic waves: Discussion on rock mechanical and electrical properties", Journal of Petroleum Science and Engineering, Journal Pre-Proof, Elsevier B.V., 2020, doi: https://doi.org/10.1016/j.petrol.2020.107309 (39 pages).

Singh, K., et al., "Thermo Chemical In-Situ Heat Generation Technique to Remove Organic Solid Deposition: Effective Tool for Production Enhancement and Flow Assurance", OTC 23933, Offshore Technology Conference, May 2013, pp. 1-14 (14 pages).

Vlaicu, Mihaela, et al., "Downhole Heating Technology—New Solution for Paraffinic Wells", SPE-206128-MS, Society of Petroleum Engineers, Sep. 2021, pp. 1-24 (24 pages).

* cited by examiner

MICROWAVE HEATING TECHNIQUE FOR TREATMENT OF CONDENSATE BUILDUP

BACKGROUND

Condensates are low-density liquid hydrocarbons commonly found in gas reservoirs. Depending on the reservoir temperature and pressure, condensates may exist in a liquid or gas phase. During production, condensates in the gaseous phase often condense into the liquid phase due to a drop in reservoir pressure below the dewpoint. Similarly, as gaseous condensates travel up the well to production tubing, the pressure naturally drops, often below the dewpoint, resulting in condensate buildup closer to the surface. The buildup of condensates can form a barrier that disrupts the production of gas from the well. Therefore, numerous techniques have been developed to treat wells with condensate buildup.

Generally, condensates are reduced via gas injection, huff-n-puff treatment (a process of injection, soaking, and production), and various chemical and thermochemical treatments. These techniques typically incur high costs, environmental damage, and lost time, as they often require the well to be temporarily shut down. Other treatment options aim to proactively address condensate buildup by maintaining the bottomhole pressure of a well above the dewpoint, such that gaseous condensates remain in the gaseous phase. Conventionally, this approach can lead to early abandonment of the well, and, as above, incur high operating costs.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole tool including a body that includes a microwave generator, a susceptor shell connected to the body, and a thermometer connected to the body. The susceptor shell includes a wall made of a susceptor material and a cavity formed between the wall and the body.

In another aspect, embodiments disclosed herein relate to a system including a well extending from a surface, a microwave heating tool positioned in the well, and an electrical cable extending from a power source at the surface to the microwave heating tool. The microwave heating tool includes a body including a microwave generator and a susceptor shell connected to the body.

In yet another aspect, embodiments disclosed herein relate to a method of treating condensate buildup in a well. The method includes lowering a microwave heating tool into the well to a treatment zone including accumulated condensates. The microwave heating tool incudes a microwave generator, a susceptor material having a cavity, and a thermometer, wherein the microwave generator is attached to the cavity of the susceptor material. The method then includes providing power to the microwave heating tool via an electrical cable, generating microwave radiation from the microwave generator that is then absorbed by the susceptor material, which upon absorption of the microwave radiation generates heat, increasing a temperature of the treatment zone to an elevated temperature using the generated heat, and removing the accumulated condensates in the treatment zone.

Other aspects and advantages of the claimed subject matter will be apparent from the following description and the appended claims.

BRIEF DESCRIPTION OF DRAWINGS

Wherever possible, identical reference numerals are used in the figures to identify common or the same elements. The figures are not necessarily to scale and certain features and certain views of the figures may be shown exaggerated in scale for purposes of clarification.

DETAILED DESCRIPTION

Figure 1A:
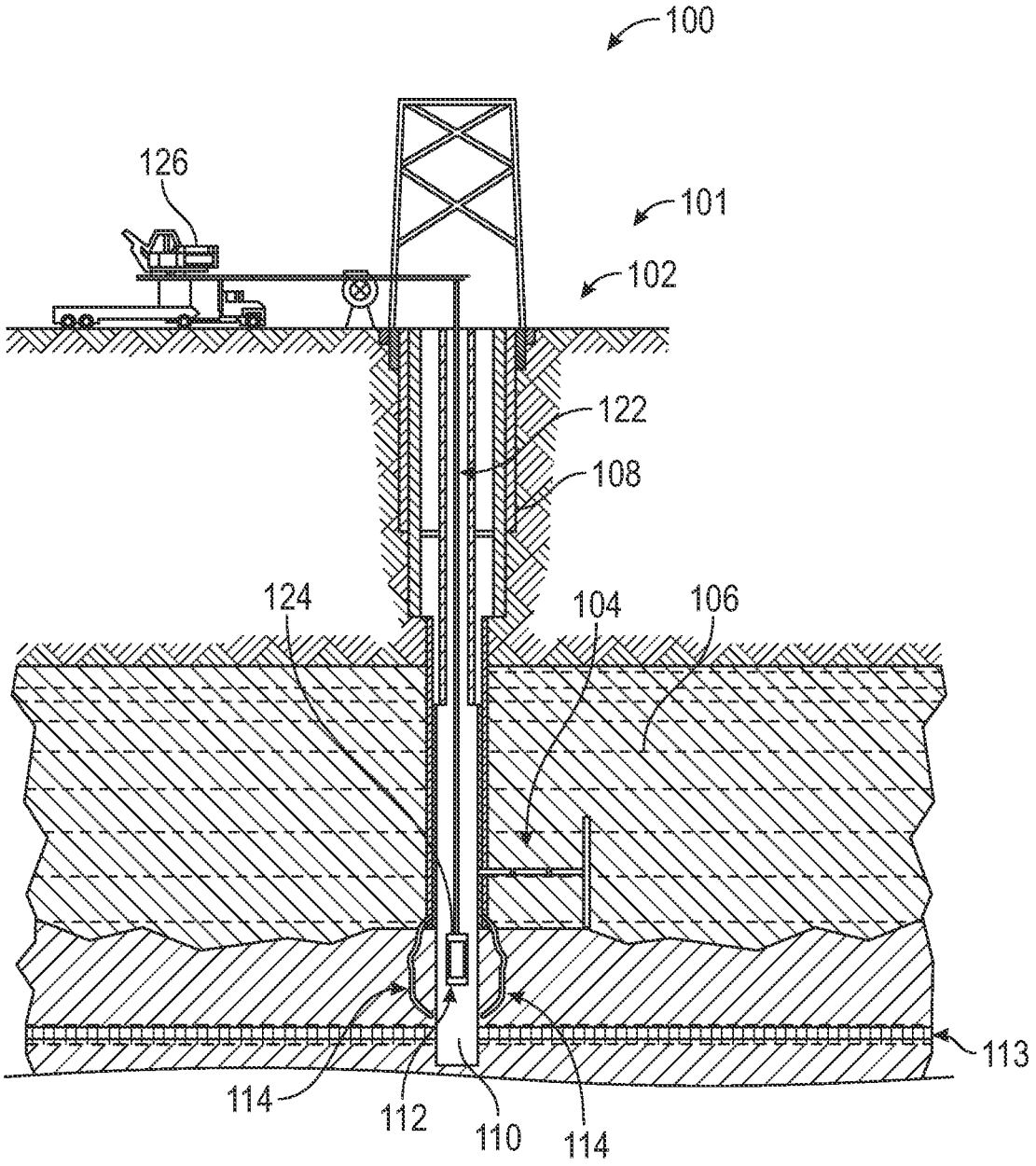
FIG. 1A is schematic diagram of a system in accordance with one or more embodiments of the present disclosure.

Embodiments disclosed herein generally relate to systems and methods for heating and treating selected areas of a well, e.g., to treat condensate buildup in the near wellbore region of a hydrocarbon reservoir. Systems in accordance with the present disclosure include a downhole microwave heating tool including a microwave generator, a susceptor material, and a thermometer. Such systems may be used to heat a selected area of a wellbore. For example, methods in accordance with one or more embodiments may include lowering the microwave heating tool into a wellbore to a treatment zone and heating the treatment zone to an elevated temperature. In some embodiments, the microwave heating tool may be lowered to a treatment zone having condensates accumulated in the near wellbore region, where the microwave heating tool may heat the treatment zone, such that the accumulated condensates reenter the gas phase. In such manner, the microwave heating tool may be used to reduce or eliminate condensates that have accumulated in the near wellbore region.

A system in accordance with one or more embodiments is shown in, and discussed with reference to, FIG. 1A. System 100 includes well environment 101 having surface 102 and subsurface 106. A well 110 having wellbore wall 108 extends downhole from surface 102 into subsurface 106, and through a hydrocarbon reservoir 113. Hydrocarbon reservoir 113 may be a gas reservoir. Near wellbore region 104 extends out from wellbore wall 108 into subsurface 106. A treatment zone 112 may be selected along the length of the well 110, for example, as a region of the well 110 located above the hydrocarbon reservoir 113. In some embodiments, the treatment zone 112 may extend a few feet through the hydrocarbon reservoir 113. In one or more embodiments, treatment zone 112 contains accumulated condensates 114 in near wellbore region 104. In such embodiments, the treatment zone 112 may be along an uncased or perforated section of the well, so that the condensates, once in the gaseous phase, may escape through the well.

Condensates often accumulate in the near wellbore region of hydrocarbon reservoirs during production due to a decrease in bottomhole pressure. These condensates may have been in the gas phase at natural reservoir conditions, e.g., elevated pressure and temperature. However, upon production, the dewpoint pressure of the gas is typically reached in the near wellbore region, resulting in condensate buildup, as shown in FIG. 1A. Exemplary condensates that may accumulate around a wellbore wall include, but are not limited to, alkanes such as butane, pentane, hexane, and combinations thereof.

While the system 100 shown in FIG. 1A shows one example of a well 110 configuration to be treated, other types of wells may be treated according to embodiments disclosed herein. For example, embodiments of the present disclosure may also be used with horizontal or other directional wells, wells having production tubing installed, wells having at least a portion of the wellbore wall cased or lined (e.g., as shown in FIG. 1A), uncased wells, and wells that extend to other types of reservoirs or wells that do not extend to hydrocarbon reservoirs.

Systems 100 in accordance with one or more embodiments may also include a microwave heating tool 124 positioned inside well 110. The microwave heating tool 124 may be lowered into a well via a wireline or other type of running tool including an electrical cable 122, which may connect the microwave heating tool 124 to surface equipment 126. The surface equipment 126 may have an electrical power source. In one or more embodiments, surface equipment 126 supplies electrical power to microwave heating tool 124 through electrical cable 122. As depicted in FIG. 1A, electrical cable 122 may be provided as a wireline to suspend microwave heating tool 124 in a position in the well 110. The microwave heating tool may be suspended in a position at or near treatment zone 112. Additionally, the microwave heating tool 124 may be lowered into, raised out of, and moved to different positions within the well using the wireline. Advantageously, by using a microwave heating tool 124 according to embodiments disclosed herein, which may be positioned in a well via a wireline or other type of running line, the microwave heating tool 124 may be easily repositioned within the well (e.g., to treat multiple treatment zones in the well) and/or reused in different wells.

Figure 1B:
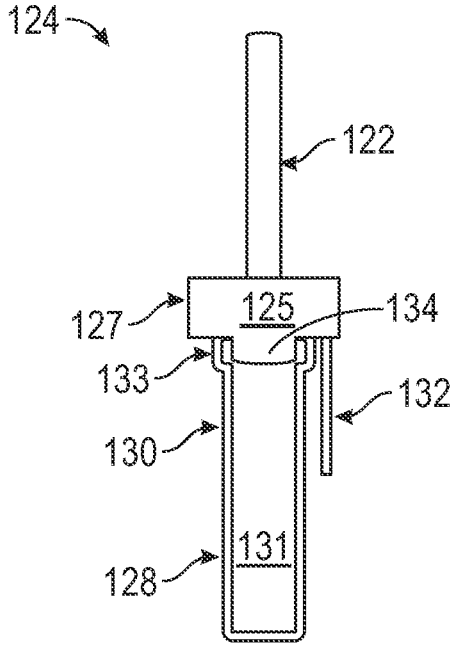
FIG. 1B is a schematic diagram of a downhole tool in accordance with one or more embodiments of the present disclosure.

A schematic diagram of microwave heating tool 124 is shown in FIG. 1B. Microwave heating tool 124 has a body 125 that includes microwave generator 127. Microwave generator 127 may be any suitable microwave generator known in the art.

As depicted in FIG. 1B, the body 125 of microwave heating tool 124 is connected to electrical cable 122 on a first side and susceptor shell 128 on a second side which is opposite the first side. Susceptor shell 128 may form wall 130 connected to and extending from the body of the microwave heating tool such that the microwave generator is positioned at an opening of cavity 131 of the susceptor shell. In some embodiments, a susceptor shell may coat a second side of the body of the microwave heating tool, where a cavity is not provided between the susceptor shell and the microwave heating tool body.

The susceptor shell may be any size that fits downhole. The size of the susceptor shell may be related to the amount of heat that is delivered downhole. For example, a relatively large susceptor shell may be used to deliver more heat whereas a relatively small susceptor shell may be used to deliver less heat. Relatively larger susceptor shells may be designed, for example, by designing the susceptor shell to extend farther from the microwave heating tool body (and thus having a relatively larger cavity formed between the microwave heating tool body and the susceptor shell). In such manner, susceptor shells may define cavities of different sizes to provide different sizes of susceptor shells, and thus deliver different amounts of heat. By designing larger susceptor shells to extend a greater axial length away from the microwave heating tool body (as opposed to using a susceptor shell with an increased radial width), the susceptor shell may deliver an increased amount of heat while also being capable of fitting downhole through a well.

The microwave generator 127 may convert electricity supplied from the electrical cable 122 to microwave radiation. The generated microwave radiation may be directed (e.g., through a wave guide) into the cavity 131 formed within the susceptor shell 128. The wall of susceptor shell 128 may be made of a susceptor material. The susceptor material may include any suitable material able to absorb the microwave radiation from microwave generator 127. Suitable susceptor materials may also exhibit rapid heating ability upon exposure to microwave radiation. For example, in one or more embodiments, the susceptor material is activated carbon, silicon carbide, aluminum oxide, or combinations thereof.

The susceptor shell may have a rigid structure. As such, upon lowering downhole, should the microwave heating tool contact the formation, the susceptor shell may be damaged. To mitigate damage, the susceptor shell may have a thickness and strength sufficient to withstand downhole conditions, such as increased and contact with the well wall.

A susceptor shell may be connected to a body of a microwave heating tool using one or more connection elements to attach an end of the susceptor shell to the body. For example, as shown in FIG. 1B, a susceptor shell 128 may include an opening at an axial end 133, where the opening may be fitted around an extension 134 from the microwave heating tool body 125. The axial end 133 may be connected to the body 125 using, for example, a clamp, bolts, or other connection element.

Figure 1C:
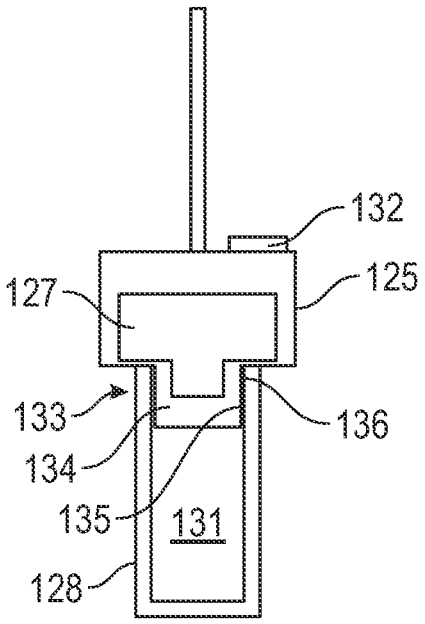
FIG. 1C is a schematic diagram of a downhole tool in accordance with one or more embodiments of the present disclosure.

In another example, as shown in FIG. 1C, a susceptor shell 128 may have a threaded portion 135 formed at an axial end 133, where the threaded portion 135 may be threaded to a corresponding threaded portion 136 along the microwave heating tool body 125. In the embodiment shown, the microwave heating tool body 125 may hold a microwave generator 127. The microwave generator 127 may be arranged within the body 125 such that microwave radiation is directed by a wave guide through an extension 134 of the body 125. The threaded connection between the susceptor shell 128 and the body 125 may be provided around the extension 134 of the body, where the susceptor shell extends axially from the extension 134 away from the body 125. In such configuration, when microwave radiation exits the extension 134, the microwave radiation may enter the cavity 131 in the susceptor shell 128 and heat the susceptor shell 128.

Other designs of a microwave heating tool body having a microwave generator may be envisioned. According to embodiments of the present disclosure, a susceptor shell may be connected to a microwave heating tool body having various shapes using various connection configurations in a manner to where microwave radiation from a microwave generator in the microwave heating tool body is directed into a cavity formed within the susceptor shell.

Microwave heating tool 124 may also include thermometer 132. Thermometer 132 may be any suitable known temperature measurement device. In some embodiments, the thermometer 132 may be attached along a side of the microwave heating tool body 125 and extend axially from the body in an outer area around the susceptor shell 128. By positioning the thermometer in an outer area around the susceptor shell 128, a more accurate reading of the temperature of the susceptor shell 128 may be collected. In other embodiments, a thermometer may be positioned along different portions of the microwave heating tool body, or disposed on the electrical cable 122, proximate to the microwave heating tool body.

In one or more embodiments, thermometer 132 is used to measure the downhole temperature of treatment zone 112 before treating with microwave heating tool 124. Temperature measurements taken by thermometer 132 may be sent to the surface of the well for processing via the wireline on which the microwave heating tool is deployed. In some embodiments, thermometer 132 is used to monitor the temperature change in the treatment zone of the wellbore upon treatment with microwave heating tool 124. In such embodiments, thermometer 132 may provide real-time temperature data to surface equipment 126 for processing, analysis, or data storage, for example.

In some embodiments, real-time temperature data may be used to determine how much electrical power to supply to microwave heating tool 124. For example, if the temperature of the treatment zone is not hot enough, power may be supplied at a greater wattage or for a longer period of time in order to achieve the desired temperature and remove the accumulated condensates. On the other hand, if the temperature of the treatment zone is too hot, power to the microwave heating tool may be cut, and the tool may be raised so as not to be damaged at the increased temperature. The microwave heating tool may be used at any downhole temperature. For example, the microwave heating tool may be operable at temperatures ranging from 50 to 150° C.

In heating the downhole environment, the microwave heating tool may heat to a temperature ranging from 50 to 800° C., or more. For example, the microwave heating tool may heat to a temperature ranging from a lower limit of one of 50, 100, 150, 200, 250, 300, and 400° C. to an upper limit of one of 400, 500, 600, 700, and 800° C., where any lower limit may be paired with any mathematically compatible upper limit. However, it may not be necessary to heat much beyond the natural downhole temperature.

Figure 2:
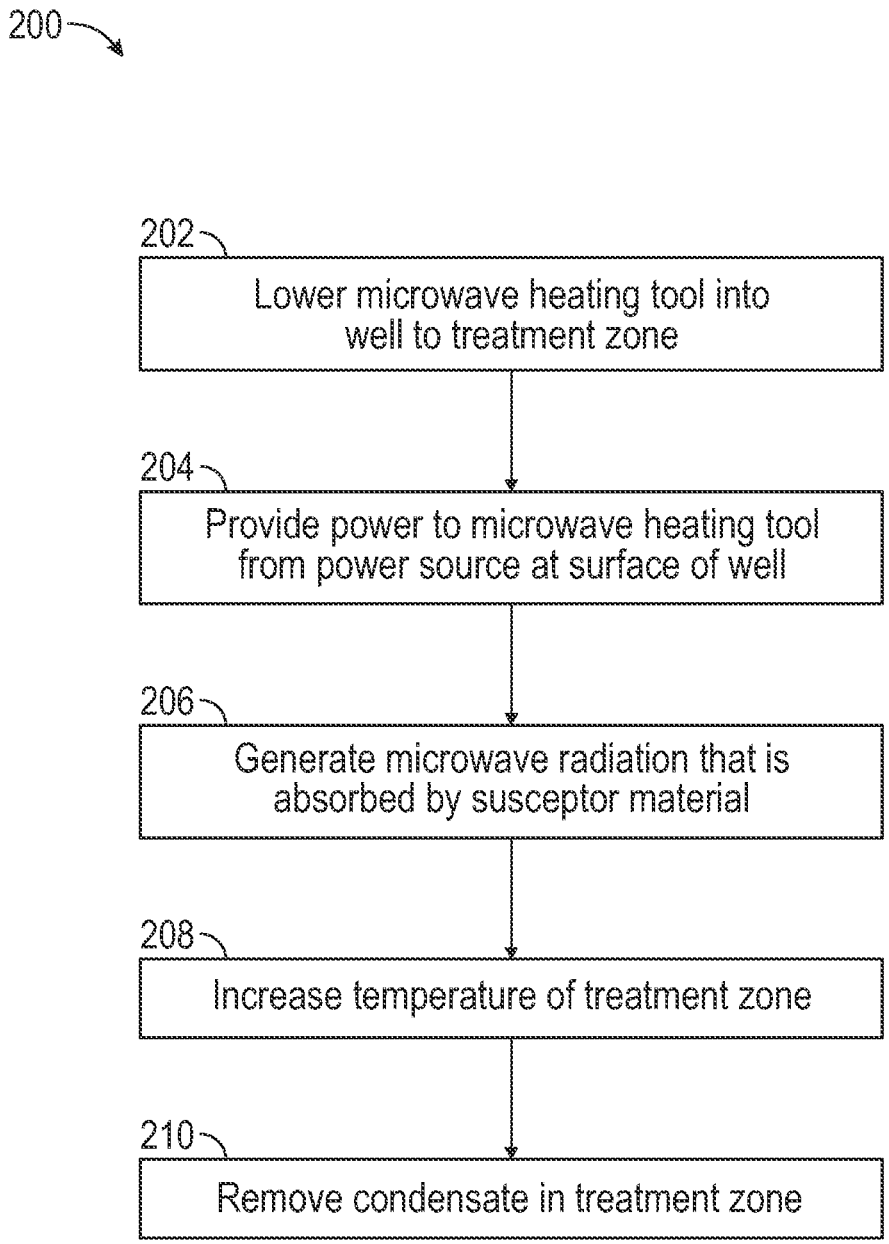
FIG. 2 is a block-flow diagram of a method in accordance with one or more embodiments of the present disclosure.

A method 200 for treating a well using a system in accordance with one or more embodiments is depicted in FIG. 2. The method 200 may be used, for example, to treat a portion of the well containing accumulated condensates, such as those occurring from production of a gas reservoir. Method 200 initially includes lowering a microwave heating tool according to embodiments of the present disclosure into a well to a treatment zone 202. The treatment zone may contain accumulated condensates. In one or more embodiments, the microwave heating tool may be lowered to the treatment zone in the well using an electrical cable (e.g., provided as a wireline) connected to a power source at a surface of the well.

Once the microwave heating tool is positioned in the well at the treatment zone, method 200 includes providing power to the microwave heating tool from the power source at the surface of the well via the electrical cable 204. The microwave heating tool may heat rapidly. For example, it may take about 10 seconds to 5 minutes for the microwave heating tool to heat the target zone to the desired temperature. In one or more embodiments, the microwave heating tool may heat the treatment zone for an amount of time ranging from a lower limit of one of 10, 20, 30, 40, 50, and 60 seconds to an upper limit of one of 2, 3, 4, and 5 minutes, where any lower limit may be paired with any mathematically compatible upper limit. As such, the amount of power required to heat the microwave heating tool may be minimal.

Upon receiving power, the microwave generator may emit microwave radiation that is then absorbed by the susceptor material 206. As described above, the susceptor material may exhibit rapid heating upon absorption of microwave radiation. Accordingly, in method 200, rapid heating of the susceptor material leads to dissemination of that heat into the treatment zone, effectively increasing the temperature of the treatment zone to an elevated temperature 208. In one or more embodiments, the treatment zone may be heated by the susceptor material to an elevated temperature suitable to facilitate a phase change of the accumulated condensates 210 to the gas phase. For example, the treatment zone may be heated to a temperature ranging from 50 to 800° C. Depending on the type of susceptor material and the time and power of heating, the treatment zone may be heated to a temperature ranging from a lower limit of one of 50, 100, 150, 200, 250, 300, and 400° C. to an upper limit of one of 400, 500, 600, 700, and 800° C., where any lower limit may be paired with any mathematically compatible upper limit.

When condensates undergo a phase change to a gas phase, the gas may be removed from the near wellbore area and flowed to the surface of the well. Additionally, as condensates are removed from the near wellbore area, hydrocarbons from the surrounding wellbore area may escape through the cleared near wellbore area and produced (e.g., flowed through production tubing to the surface of the well).

As previously described, a thermometer on the microwave heating tool may be used to monitor the change in temperature of the treatment zone. In one or more embodiments, after heating the treatment zone to a temperature sufficient to remove the accumulated condensates, the microwave heating tool may be removed from the well.

In one or more embodiments, as an effect of the increased temperature, the pressure in the treatment zone may increase as well. The pressure increase may be directly related to the temperature increase of the treatment zone. In such embodiments, the increased pressure and temperature of the treatment zone may aid in the removal of accumulated condensates in the near wellbore region.

Embodiments of the present disclosure may provide at least one of the following advantages. By using downhole microwave heating tools according to embodiments of the present disclosure (including a microwave generator and a susceptor material provided in a single tool), the microwave heating tool may be moved through a well to a selected area to be treated. Additionally, the microwave heating tool may be used at multiple different depths in a single wellbore and in various different wellbores. Further, by using microwave energy to heat a susceptor element, which heats a surrounding wellbore area, a relatively low amount of energy may be used to heat the selected area of the well being treated. Accordingly, systems and methods described herein may provide an inexpensive, environmentally friendly, simple method for treating condensate buildup in a well and near wellbore region.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A downhole tool, comprising:

a body comprising:

a microwave generator; and a wave guide provided in an extension of the body extending from a first side of the body;

a susceptor shell connected to the first side of the body, the susceptor shell comprising:

a wall made of a susceptor material:

a cavity formed between the wall and the body; and an opening to the cavity formed at an axial end of the susceptor shell, wherein the opening is fitted around and connected to the extension of the body, and wherein the microwave generator is positioned in the body proximate the opening to the cavity; and a thermometer connected to an outer side of the body and positioned outside of the susceptor shell.

2. The downhole tool of claim 1, further comprising an electrical cable extending between and connected to the body and a power source located at a surface of a wellbore.

3. The downhole tool of claim 2, wherein the electrical cable is connected to a second side of the body, opposite the first side.

4. The downhole tool of claim 1, wherein the susceptor material is selected from the group consisting of activated carbon, silicon carbide, aluminum oxide, and combinations thereof.

5. The downhole tool of claim 1, wherein the thermometer extends axially from the body in an outer area around the susceptor shell.

6. A system, comprising:

a well extending from a surface;

a microwave heating tool positioned in the well, the microwave heating tool comprising:

a body comprising:

a microwave generator; and a wave guide positioned along a first side of the body;

a susceptor shell connected to the first side of the body, wherein the susceptor shell is a coating that coats the first side of the body; and a thermometer connected to an outer side of the body; and an electrical cable extending from a power source at the surface to the microwave heating tool, wherein the electrical cable is connected to a second side of the body, opposite the first side of the body.

7. The system of claim 6, wherein the microwave heating tool is positioned in a portion of the well extending through a hydrocarbon reservoir.

8. The system of claim 7, wherein the hydrocarbon reservoir is a gas reservoir.

9. The system of claim 6, wherein the electrical cable suspends the microwave heating tool in a position in the well.

10. A method of treating condensate buildup in a well, comprising:

lowering a microwave heating tool into the well to a treatment zone comprising accumulated condensates, wherein the microwave heating tool comprises:

a body comprising:

a microwave generator; and a wave guide provided in an extension of the body extending from a first side of the body;

a susceptor shell connected to the first side of the body, the susceptor shell comprising:

a wall made of a susceptor material;

a cavity formed between the wall and the body; and an opening to the cavity formed at an axial end of the susceptor shell, wherein the opening is fitted around and connected to the extension of the body, and wherein the microwave generator is positioned in the body proximate the opening to the cavity; and a thermometer connected to an outer side of the body and positioned outside of the susceptor shell, wherein the microwave generator is attached to the cavity of the susceptor material;

providing power to the microwave heating tool via an electrical cable, wherein the electrical cable electrically connects the microwave generator to a power source at a surface of the well;

generating microwave radiation from the microwave generator that is then absorbed by the susceptor material, which upon absorption of the microwave radiation generates heat;

increasing a temperature of the treatment zone to an elevated temperature using the generated heat; and removing the accumulated condensates in the treatment zone.

11. The method of claim 10, wherein the susceptor material is selected from the group consisting of activated carbon, silicon carbide, aluminum oxide, and combinations thereof.

12. The method of claim 10, wherein the thermometer is used to monitor the temperature of the treatment zone during treatment.

13. The method of claim 10, further comprising increasing a pressure in the treatment using the increase in the temperature of the treatment zone.

14. The method of claim 10, further comprising:

after the temperature of the treatment zone increases to the elevated temperature, removing the microwave heating tool from the treatment zone.

15. The method of claim 10, wherein the treatment zone is in a portion of the well extending through a gas reservoir.

16. The method of claim 10, wherein the microwave heating tool is lowered into the well using the electrical cable.

* * * * *